United States Patent [19]

Burch

[11] 4,440,229

[45] Apr. 3, 1984

[54] OIL WELL SERVICING PROCESSES

[76] Inventor: Julius G. Burch, 822 S. McGee, Borger, Tex.

[21] Appl. No.: 390,812

[22] Filed: Jun. 22, 1982

[51] Int. Cl.[3] ..... E21B 37/02

[52] U.S. Cl. ..... 166/311

[58] Field of Search ..... 166/311, 304, 302, 369, 166/381, 170–176; 15/104.15–104.19

[56] References Cited

U.S. PATENT DOCUMENTS

| | | | |
|---|---|---|---|
| 2,695,670 | 11/1954 | Crake | 166/311 |
| 2,785,757 | 3/1957 | Middleton | 166/170 |
| 3,141,505 | 7/1964 | Tripplehorn | 166/311 |
| 3,171,487 | 3/1965 | Ault | 166/170 |
| 3,394,763 | 7/1968 | Page, Jr. | 166/311 X |
| 3,399,730 | 9/1968 | Pourchot | 166/176 |
| 3,456,727 | 7/1969 | Nettles | 166/170 |
| 3,983,938 | 10/1976 | Hellums et al. | 166/176 |

OTHER PUBLICATIONS

*Paraffin and Concealing Oil Problems* by Reistle, Jr.; U.S. Government Printing Office, Washington, 1932; pp. 60–68; 87–97.

*Primary Examiner*—Stephen J. Novosad
*Assistant Examiner*—Thuy M. Bui
*Attorney, Agent, or Firm*—Ely Silverman

[57] ABSTRACT

In the systems and processes pump and rods are lifted in combination with other paraffin deposit removing tools in such a manner to enable the pump to remain substantially in the exact center of the tubing all the way to and from the surface and remove accumulated paraffin from the tubing wall while the tubing remains full of fluid.

3 Claims, 23 Drawing Figures

FIG.20
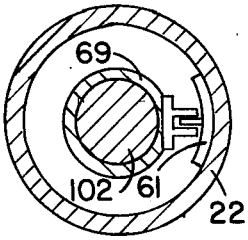
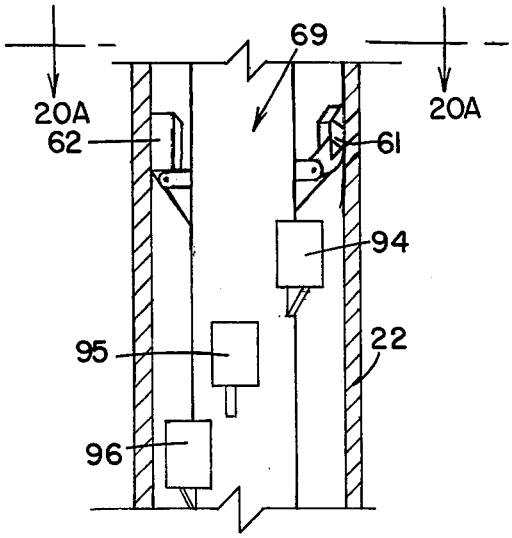
FIG. 21
FIG.22
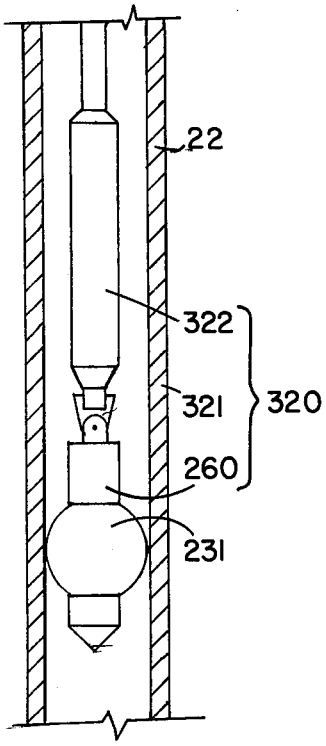

OIL WELL SERVICING PROCESSES

BACKGROUND OF THE INVENTION

1. The field of this invention is oil well production and servicing.

2. Description of the Prior Art.

The Panhandle of Texas and many other oil fields produce paraffin-base oil, while while other fields produce asphalt-base oil. Paraffin-base oil causes a problem and is expensive to produce because the oil derived continues to release paraffin inside the wells' walls, adhering to tubing, rods, paddles, etc. A sticky, gummy, substance, known as paraffin rather quickly clogs the tubing, thus reducing the efficiency of the energy used for production.

When a well's temperature at oil formation is below 160 degrees fahrenheit, the well is subject to increased paraffin deposit problems. Wells in the Panhandle of Texas have a temperature ranging between 80–85 degrees Fahrenheit, which means that in such wells, a steady build-up of paraffin on the interior within the walls of the wells' tubing occurs as a result of such comparatively low temperatures, which affects the pumping equipment notwithstanding use of rotating paddles.

With the wearing of pump parts, the pump will no longer pump fluids into the above ground storage tanks. This requires the pulling of the pump to the surface to be overhauled or replaced with a pump that will lift properly.

When the pump piston and sucker rods attached thereto are now pulled by conventional practices from the pump's seat, which is initially precisely in the center of the tubing, in returning to the surface the pump piston does not remain in the center of the tubing but scrapes the sides of the interior wall of the tubing string while creating unequal deposits of paraffin on the tubing walls.

This occurs because when the pump has been pulled from its seat and dragged against the tubing wall to the surface, it changes direction as it moves and scrapes the sides of the tubing and paraffin deposit on the wall in some places, leaving a ½ inch thick accumulation in others. The bare tubing and ½" paraffin patches within the wall create a zig-zag, off-set puzzle which made re-entry of the pump against a maze of friction too great a risk for practical relible economic use.

Producers have ceased the practice of using standing valves, (those valves left in the tubing below the pump which retain the fluids in the tubing when the pump and rods are pulled). This, in turn, causes the fluids to flow back into the well. The reason usually offered for not using a standing valve is the great risk incurred in trying to re-run the pump and rods back into the tubing, as such a practice creates a build-up of paraffin in and on the pump that results in stoppage prior to achieving seating, whereupon the pump and rods must be pulled again. In addition, the tubing must be pulled and steam-cleaned.

The dumping of the fluids back into a well's pay formation is a prime factor in reducing the well's capacity to produce at maximum level and causes much expense later in cleaning the formation with heat, chemicals, or tools. It requires a significant amount of energy to refill the tubing, and the delay in the resumption of production adds to the total loss. Accordingly, by conventional practices, the repair or changing of the pump in order to resume production causes much waste of time, energy, and pre-depletion of the tubing.

SUMMARY OF THE INVENTION

In this system and process pump and rods are lifted in combination with other paraffin deposit removing tools in such a manner to enable the pump and rods to remain substantially in the exact center of the tubing all the way to and from the surface and remove accumulated paraffin from the tubing wall while the tubing remains full of fluid.

BRIEF DESCRIPTION OF THE DRAWINGS

FIG. 16-B is a transverse diagrammatic cross sectional view along plane 16B—16B of FIG. 15.

FIG. 20 is a top diagrammatic sectional view of portions of stripper unit 80 along plane 20A—20A of FIG. 21.

FIG. 21 is the side view of only the array of the stripper blades of the cutter assembly relative to the nipple; more details of the stripper unit are shown in FIG. 5.

FIG. 22 is a diagrammatic showing of a trowel and the swab 260 in operative position.

DESCRIPTION OF THE PREFERRED EMBODIMENT

Figure 1:
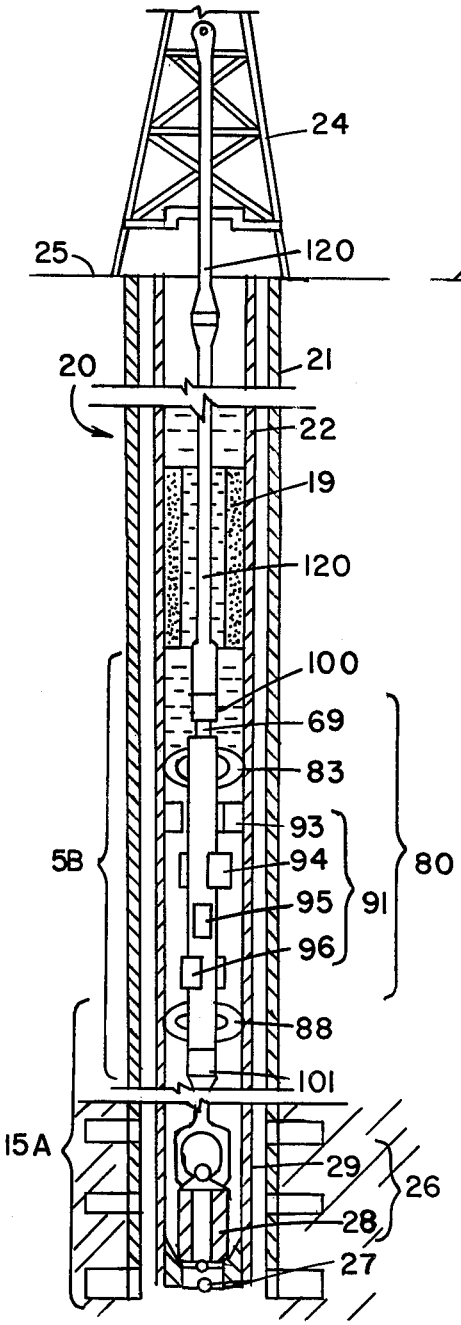
FIG. 1 is a diagrammatic vertical longitudinal overall sectional view of a well and the well tubing and stripper unit 80 therein in an operative position.
Figure 2:
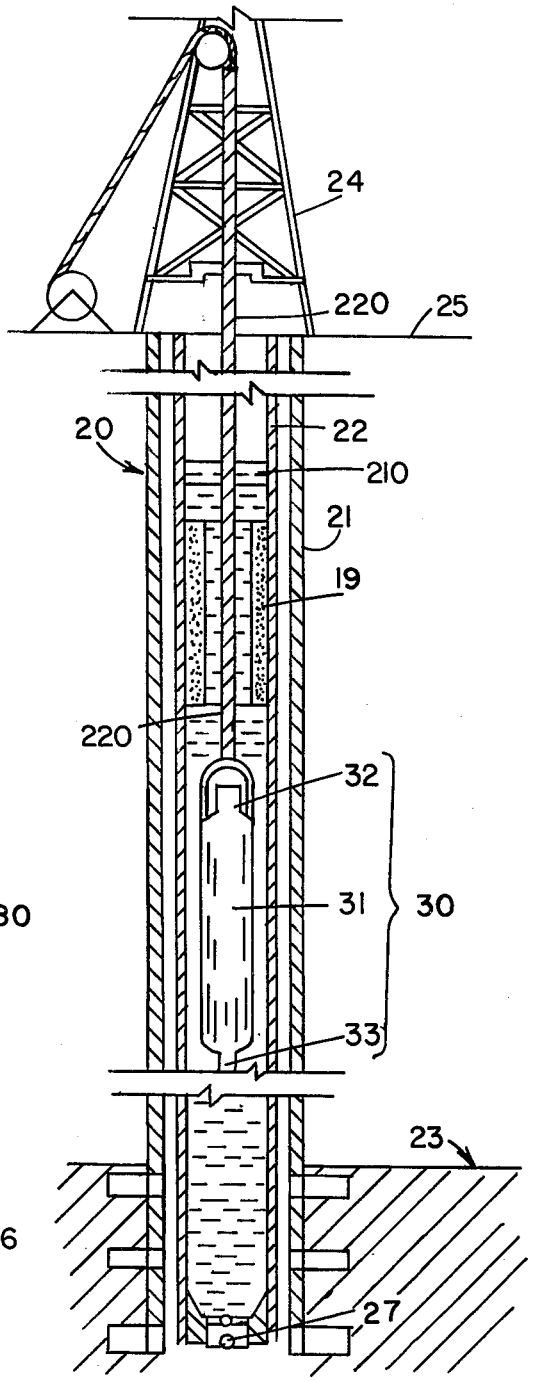
FIG. 2 is a diagrammatic vertical longitudinal overall sectional view of a well and a heater unit 30 in a state of operation of that heater unit while supported on a wire line 220.
Figure 3:
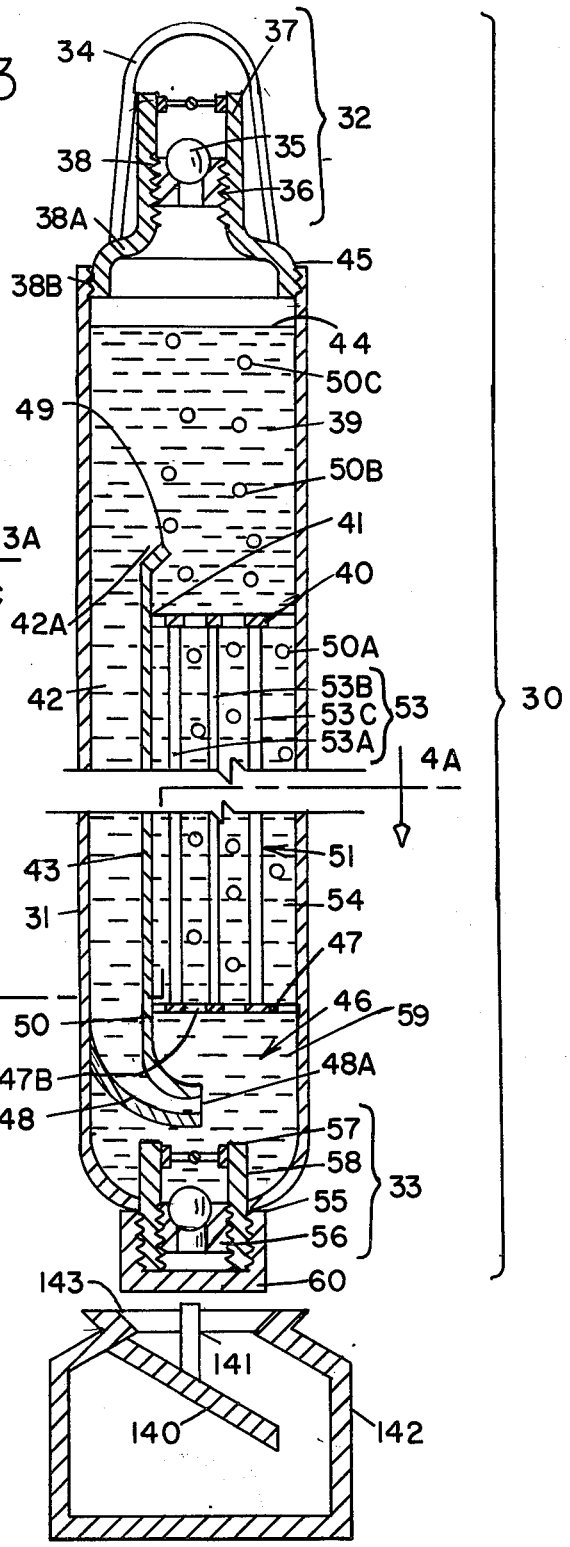
FIG. 3 is a diagrammatic vertical longitudinal sectional view of heater unit 30 along plane 3A—3A of FIG. 4 and an emptying receptacle therefor.
Figure 4:
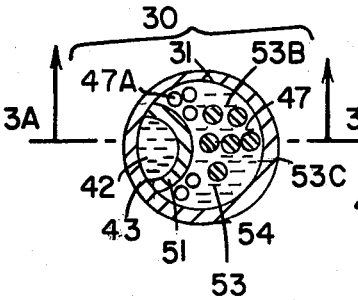
FIG. 4 is a diagrammatic transverse sectional view of heater unit 30 along broken or stepped section 4A—4A of FIG. 3.

The apparatuses described herein operate in a well 20 comprising a casing 21 and string of tubing 22 reaching to a pay formation 23 and provided with a surface rig 24 on surface 25 for raising and lowering well tools on a sucker rod string 120 or on a wire line 220.

The tubing string 22 has at its bottom a conventional pump 26 and a standing valve 27. The conventional pump with a plunger 28 and a traveling valve 29 are supported on the sucker rod string 120. The well is one that develops a typical paraffin deposit layer shown as 19 on the interior wall of the tubing. It is such deposits that are removed by the apparatuses and processes disclosed herein.

The tools described herebelow, by choice, can be used for different procedures, all of which will accomplish the desired result with significant savings, especially in the Panhandle area of Texas where most of the wells are 3,000 feet deep at the pay formations. The top 1,000 feet provides most (about 95%) of the paraffin deposits. These procedures are necessary until all pumps and tubing are adjusted to make possible a withdrawal that retains the pump in the exact center of the tubing. The procedures described comprise the following, all of which are performed while the tubing 22 is full of liquid:

(1) A radial heater 30 is run to liquify paraffin, making possible a smooth re-entry of pump plunger and rods.

(2) One paraffin scraper 180 is used to release paraffin from the top down and (3) A second scraper 80 is used to release paraffin on moving upwards. The paraffin will float and cause no impediment to re-entry of pump plunger and rods.

(4) An expandible swab 260 is passed downward through the tubing and expands upon pulling upward.

(5) A trowel 250, ¼ inch larger in diameter than the pump plunger moves down in the exact center of the tubing and (6) A centralizer unit 281 that guides a pump and thereto attached apparatuses through the tubing.

On pump renewal according to the processes of this invention there are approximately 3½ barrels of paraffin on the tubing walls, rods, and paddles which are recovered and will be pumped into above ground storage tanks and may be sold as good oil.

The processes described herein will take much better care of a well's ability to produce its natural best and correct usual costly waste of time and energy and are simple and practical; they provide that the standing valve is put in the well to stay and the tubing stays in the well while pump and rods are returned to proper seating. Thereby the paraffin-base well can now compete economically with an asphalt-base well.

THE HEATER UNIT 30

The heater unit 30 comprises a rigid hollow cylindrical shell 31, an upper check valve unit 32, a lower check valve unit 33, and, within shell 31, an upper reservoir chamber 39, an intermediate reaction chamber 51, a lower chamber 46, and a conduit channel 42.

The, cylindrical side wall of shell 31 is imperforate and the shell is joined firmly at its top to the bottom of the upper check valve unit 32 and, at its bottom, to the top of the lower check valve unit 33. An upwardly extending bail or hanger 34 is attached to the top of the shell 31.

The upper check valve unit comprises a conventional valve ball 35 in a seat 36 and is provided with a perforate cage 37. A rigid cylindrical bushing as 38 has a shoulder 38A which shoulder is firmly yet releasably attached to the top of the shell 31 in a water-tight and gas-tight manner, as by threads 38B and the seat 36 and the cage 37 are firmly attached to bushing 38.

The upper chamber 39 is ended or defined at its bottom by a perforated horizontal upper chamber floor plate 40 which has a large lateral opening 41. Hole 41 is located adjacent to the an upwardly extending channel or conduit 42. The channel 42 is separated from chamber 39 by an imperforate curved vertical plate 43 the sides of which plate join the shell wall.

The intermediate reaction chamber 51 extends downward from chamber 39 to plate 47 at the top of the lower chamber 46. The lower chamber 46 is bounded at its top by a rigid perforated rod support plate 47. A mass 53 of loosely packed aluminum rods, as 53A, 53B, and 53C has each rod supported on and extending vertically from the plate 47 and each rod of substantially equal length and diameter as the other rods of mass 53. The rods are ¼ to ½ inch in diameter and 6 to 20 feet long.

Plate 47 has many small holes as 47A and 47B therein. Each hole is smaller in diameter than the diameter of the rods to allow liquor 59 to quickly pass upward therethrough; the conduit 42 extends from its upper opening 42A through opening 50 in the plate 47 to side opening 41 in the plate 40 and the lower end 48 of conduit 42 extends centrally of the shell wall 31 to lower conduit opening 48A so that the upper chamber space 45 and the lower chamber 46 are thereby connected for fluid flow therebetween.

The plate 40 has many small evenly spaced holes therein equal or greater in number then the number of rods of mass 53 to equalize bubble distribution and hold the loose rods below the liquor surface. Plate 40 is loosely attached to shell 31 and may be readily removed therefrom; the rods may be removed from shell 31 by removing bushing 38 and inverting the heater 30.

A heat-producing liquid to which the steel shell 31 is passive or inactive, such as 25% caustic in water, is located in part in conduit 42 and in part in chambers 46, 51, and 39 and extends to an chamber upper liquid surface 44. A space 45 for gas is located between the upper liquid surfaces 44 and 49 and the bottom of the valve 32.

The reaction liquor 59 fills the lower part of the upper chamber 39, all of the interior of conduit 42, and all of the lower chamber 46 and also fills the spaces as 54 between the rods in the intermediate or reaction chamber 51. In the conduit 42 the liquor 59 extends to an upper conduit surface 49.

The lower check valve unit 33 comprises a valve ball 55, a lower valve seat 56, and valve ball cage 57. Unit 33 normally seals the bottom of the lower chamber 46. The seat 56 and the cage 57 are firmly attached to a lower nipple or bushing 58 and the lower valve is normally also closed by a removable external threaded cap 60.

The bushing shoulder is releasably attached as by threads 38B to corresponding threads on shell 31 to allow removal of the bushing 38 from the shell to provide access to the interior of shell 31 to place liquor 59 and the rods in chamber 51 as well as replace such rods; liquor replacement is below described.

In operation of the heater 30, the heater is run into the tubing 22 by a wire line 220 to a location in the tubing 22 below the level of the paraffin deposit 19 to dissolve paraffin and salt crystals that adhere to the interior surface of the tubing 22. The heater heats by circulating 25% caustic soda water solution in contact with and through the aluminium tubing held in chamber 51. Each pound of aluminium generates 18,200 B.T.U.; the chamber 51 may be 29 feet long. The total length of the shell 31 is 30 feet.

The structure of the heater 30 provides that, in operation of apparatus 30 liquid 59 is warmed by the reaction in chamber 51 with the aluminum tubing and generates hot hydrogen gas bubbles as 50A and 50B and 50C. Such bubbles provide for forming with liquid 59 a liquid-gas mixture which mixture flows upward of chambers 51 and 39 to the upper liquid surface 44. The liquid component of that mixture flows over the top of plate 43 to surface 49 and thence down conduit 42 to the horizontally directed opening 48A at the lower end 48 of conduit 42 while the hot hydrogen gas of that mixture first gathers in space 45 and then escapes through valve 32 into the liquid in the tubing 22 above the heater and the heater wall 31 warms the adjacent liquor within the tubing 22. The hot hydrogen gas provides turbulence and also heat to assist in melting the paraffin deposits on the tubing wall adjacent to and above the heater 30. Five gallons of Coal oil are also added to the top of the liquor in the well tubing and in a layer on top of the well liquor in the well tubing. Such coal oil layer dissolves the paraffin scraped off the tubing wall and prevents such scraped paraffin from re-depositing on the tubing wall or on the pump barrel when the pump barrel is subsequently run back into the well tubing to its downhole pumping location. The operation of the heater 30 also causes the salt crystals to dissolve within the water in the well as well as causing the paraffin deposits to become liquid and to float to the top of the water in the tubing 22. The pump and rods may thereafter be put in place with no trouble.

The heater is designed with safety features for its loading, draining, and reloading. The heater starts its reaction slowly from the cold (60–80 degrees Fahrenheit) caustic. After the heater is at location needed in the tubing it takes about 15 minutes before its action is visible at surface as determined from its release of hydrogen gas. When such gas is no longer seen all of the aluminum has been reacted or dissolved; then operator pulls the heater 30 to the surface to drain and refill. If not clean, the chambers 46, 51 and 39 are cleaned by running water through the heater.

To drain the heater 30, the cap 60 is taken off and the opening at the bottom of the valve 33 placed over a receptacle as a 10 gallon pail 142 provided with a top opening 143 and a rigid sloped plate 140 inside of and firmly fixed to a wall of the container 142 below the opening 143. The plate 140 supports a upwardly projecting rigid pin 141 sufficiently thin to fit into the valve seat 56 and such reaches to the level of the opening 143. The opening 143 is of larger internal diameter and size than the external diameter and size of the bushing 58 of lower valve unit 33. With the cap 60 removed, pin 141 is placed in contact with the ball 55 and, on upward movement of the pin, the pin moves the ball upwardly, allowing the spent liquid in chambers 46 and 39 and 51 to safely and completely drain therefrom to the receptacle.

THE STRIPPER UNIT 80

The stripper unit 80 comprises an array of stripping blades 61–68, an upper centralizer 83, a lower centralizer 88, and a support assembly 92. Unit 80 operates in combination with collars 100 and 101. The array of stripping blades comprises a plurality of like sets of stripper blades 93, 94, 95, and 96. Each set of blades (93-96) comprises a pair of circumferentially spaced apart like cutting blades as 61 and 62 in set 93, and like blades 67 and 68 for set 94, like blades 65 and 66 for set 95, and like blades 67 and 68 for set 96. Each cutting blade as 61 has an external cylindrical surface 77 with a radius of curvature the same as the radius of curvature of the interior wall or surface 89 of the tubing, and an upper horizontal cutting edge 111, and a lower horizontal bevelled edge 112, and parallel straight side edges as 151 and 161.

The support assembly 92 comprises a nipple 69, and like pivotal support assemblies as 70 for each of the like blades as 61–68. The centralizers 83 and 88 are directly connected to and supported on the nipple 69. The nipple 69 is formed of two like rigid portions 79 and 78 each semi-cylindrical in shape and firmly joined to each other. Each such portion as 79 and 78 has an exterior chordal portion, 81 on piece 79, 82 on piece 78 for each of the stripper blade sets 93-96. In this particular embodiment shown the nipple is 1 foot long and ¾ inch in interval diameter to smoothly but slidably embrace the cylindrical center portion 102 of the sucker rod 90.

Figure 9:
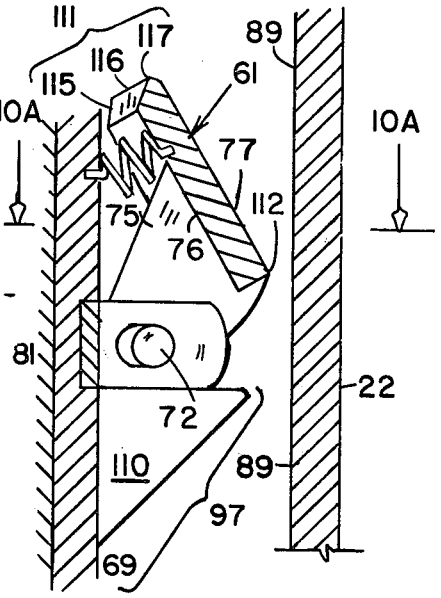
FIG. 9 is a vertical longitudinal sectional view at same scale as FIGS. 7 and 8 along a plane which corresponds to the plane 7A—7A in FIG. 8 and illustrates the position of parts when the stripper unit is moving downward of the tubing wall. Here the blade 61 is out of contact with the interior surface 89 of the tubing 22.
Figure 10:
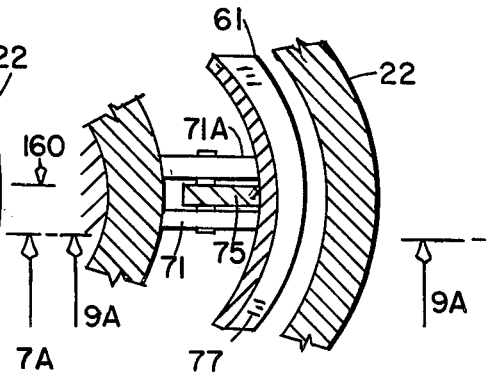
FIG. 10 is a transverse sectional view taken along te plae 10A—10A of FIG. 9.
Figure 11:
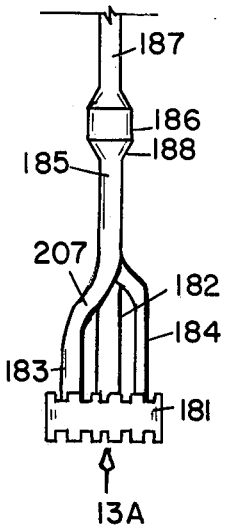
FIG. 11 is a side view of cutter assembly 180 along direction of arrow 11A of FIGS. 12 and 13.
Figure 12:
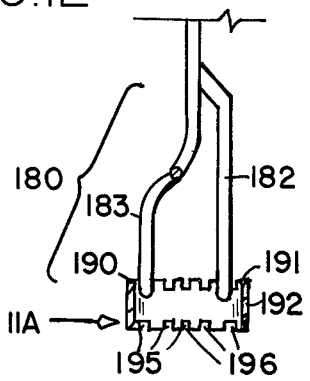
FIG. 12 is a longitudinal sectional view of cutter assembly 180 along the plane 12A—12A of FIG. 13.
Figure 13:
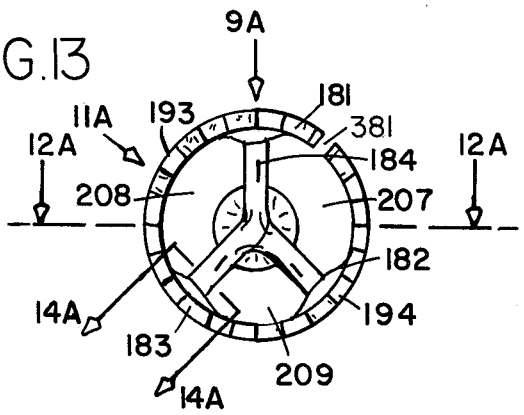
FIG. 13 is a bottom view of assembly 180 along direction of arrow 13A of FIG. 11.
Figure 14:
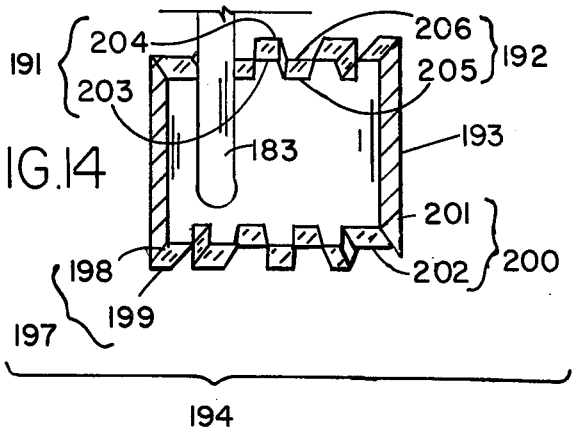
FIG. 14 is an enlarged sectional view along plane 14A—14A of FIG. 13.

The sets of blades 93–96 are longitudinally spaced apart from each other along the length of nipple 69 in sequence. Thus, the set of blades 94 is sufficiently spaced below set 93 so that any movement of any one or more blade member as 63 and 64 thereof upwardly to its contracted or raised position, (as shown in FIGS. 9 and 10 for blade 61) that the blades as 63 or 64 will not engage or contact any member of the set of blades 93 thereabove. Similarly, the set of blades 95 is sufficiently spaced below the set of blades 94 so that on movement of any one or more blade member as 65 or 66 thereof upwardly to its raised or contracted position, (as shown in FIGS. 9 and 10 for blade 61) that such blade members as 65 or 66 of set 95 will not contact or engage any member of the set of blades 94 thereabove. The set of blades 96 is sufficiently spaced below the set of blades 95 so that on movement of any one or more blade member as 67 or 68 thereof upwardly to its raised or contracted position, (as shown in FIGS. 9 and 10 for blade 61) that such blade movement as 67 or 68 of set 96 will not contact or engage any member of the set of blades 95 thereabove.

An upper centralizer 84 is formed with four curved flat radially equispaced springs as 84, 85, 86, (and one not shown) to hold the nipple and the attached blades in the center of the tubing. The springs of the centralizers are firmly attached at their ends to the nipple 69 in conventional manner.

The centralizers are slightly oversize, measured across the diameter of the tubing, so as to fit the tubing tightly and hold the nipple and the blades attached thereto from sideways movement transverse to the length of the tubing.

The support assembly 70 which connects each blade as 61 with the nipple 69 is composed of a pair of rigid parallel, laterally or radially projecting ears 71 and 71A, an arm 75 and a pin 73. Each of the ears as 71 has a elongated hole 72 therein for a rigid cylindrical pivot pin as 73. The pivot pin 73 fits into the hole 72, the hole 72 is not circular but is rounded at its ends with the same height as the diameter of the pivot pin and is longer than the diameter of the pin 73 and provides a space 74 for shifting of the pin and blade 61 relative to the nipple 69. The arm 75 is rigid and firmly attaches to the interior surface 76 of the blade 61 below its upper cutting edge 111 while the exterior surface 77 is of the same internal diameter and curvature as the interior surface 89 of the tubing 31.

Each of the bases as 107 of each of the ears 71 and 71A is firmly welded to a chordal portion as 81 of the sleeve or nipple portion 79; a chordal portion 82 of the sleeve or nipple portion 78 is similarly provided with a support assembly 70A like link assembly 70 for blade 62. The rigid steel pivot pin 73 provides for a hinging or pivoting action of the arm 75 about ears 71 and 71A.

A soft rubber C-shaped shim 174 fits in and fills the space 74 between the holding eye or hole 72 and pin 73 to provide elastic yield of the pin in the radial direction to so accomodate for "drift" or change in diameter of the tubing as to avoid interference therefrom during upward and downward travel of the unit 80 with its blades 61–68 through the tubing. The blades 61–68 also are beveled at their top and bottom to freely pass the recesses of the tubing in the vicinity of the collars therefor.

Each of the blades of set 61–68 as 61 have straight vertical sides as 151 and 161 and is in the shape of a cylindrical sector with a square or rectangular outline. The blades 61–68 are formed by cutting a piece of $\frac{1}{8}$ inch thick walled stainless steel cylindrical, 2 inch outside diameter, tubing to form 8 like cylindrical sector blanks or pieces each having side edges $1\frac{1}{2}$ inch long parallel to the central longitudinal axis of the tubing and $1\frac{1}{2}$ inch wide along the upper and lower edges thereof transverse to the longitudinal axis of the tubing. Thereby the blanks for the stripper blades as 61–68 are formed each with an curved exterior surface of one inch radius of curvature, which matches the inner surface of the tubing wall curvature. The upper blank edge is sharpened and the lower edge bevelled before firmly attaching to a steel arm as 75 by welding.

Figure 5:
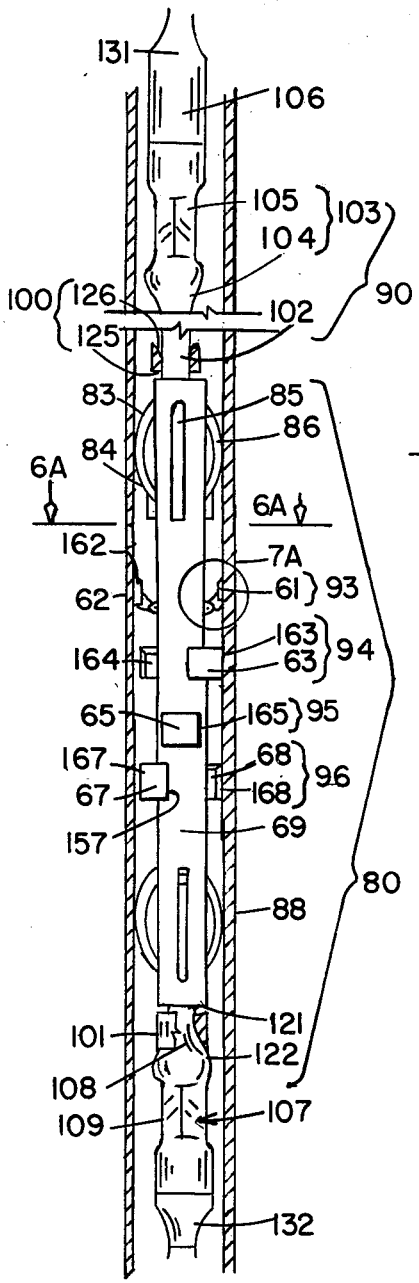
FIG. 5 is an enlarged scale view of apparatus components shown in zone 5B of FIG. 1 and shows the stripper unit 80 in side view with tubing 22 broken away and shown in longitudinal diametral section along plane 5A—5A of FIG. 6.
Figure 6:
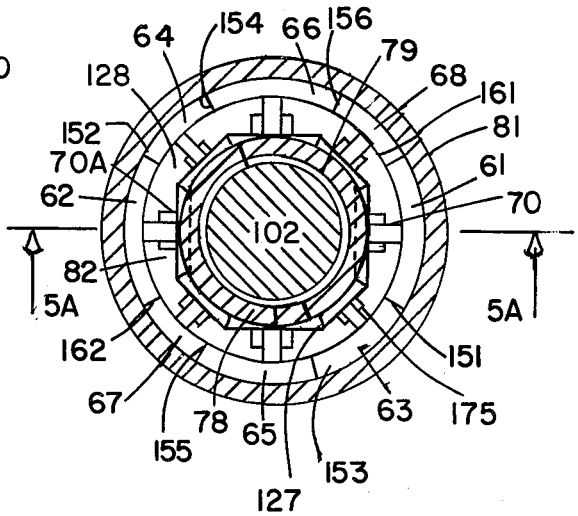
FIG. 6 is a transverse sectional scale view along plane 6A—6A of FIG. 5 to illustrate the relations of parts of unit 80 as seen from above and to show the diametral opposite position of each member of the sets of blades such as 61 and 62, 63 and 64, 65 and 66, 67 and 68 and the overlapping circumferential relations of the blades of the array 91.

In the cutting position of parts of the unit 80 the portion of the interior cylindrical surface 89 of the tubing 22 contacted by the cutting edges of the blades of the set of blades 93 overlap the edges of the portions of the interior cylindrical tubing surface 89 contacted by the cutting edges of the blades of the neighboring set of blades 94 as shown in FIGS. 5 and 6. In the cutting position of parts of the unit 80 the portions of the interior cylindrical surface 89 of the tubing 22 contacted by the cutting edges of the set of blades 94 overlap the portions of the interior cylindrical surface 89 contacted by the cutting edges of the blades of the set of blades 95 as shown in FIGS. 5 and 6. Also, in the cutting position of parts of the unit 80 the portions of the interior cylindrical surface 89 of the tubing 22 contacted by the cutting edges of the blades of the set of blades 95 overlap the edges of the portions of the interior cylindrical surface contacted by the cutting edges of the blades of the set of blades as 96 as shown in FIG. 5 and 6. In the cutting position of parts of the unit 80 the portions of the interior cylindrical surface 89 of the tubing 22 contacted by the cutting edges of the blade of the set of blades 96 overlap the edges of the portions of the interior cylindrical surface 89 contacted by the cutting edges of the blades of the set of blades 93.

Figure 8:
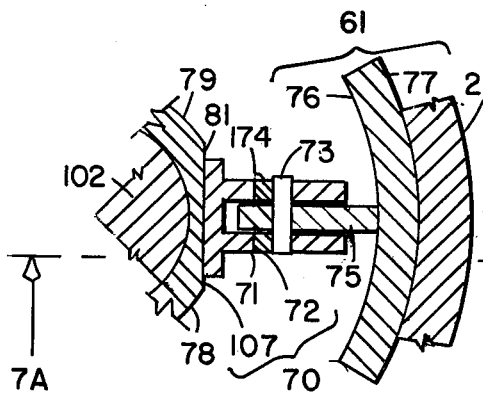
FIG. 8 is a transverse composite sectional view along the broken or stepped section 8A—8A of FIG. 7.

The blade 61 is symmetrical about a vertical center plane 160 (the same plane as 5A—5A in FIG. 6) and extends circumferentially for 60 degrees from a counterclockwise side edge 161 to a clockwise side edge 151 (shown in FIG. 6) and has a center plane of symmetry which passes through arm 75 as shown in FIG. 6 at zero (0) degrees to plane 5A—5A as shown in FIG. 6 and 8. Blade 68 also extends circumferentially for 60 degrees, but its center plane is 45 degrees counter-clockwise from plane 160. Blade 68 extends clockwise located blade side edge 158 located 15 degrees counter-clockwise of the center plane 160 of blade 61 to a counterclockwise blade side edge located 75 degrees counterclockwise of the center plane 160 of blade 61.

The cutting edge of the blade 63 also extends circumferentially for an arc of 60 degrees from a counterclockwise blade side edge 163 located 15 degrees clockwise from the center plane 160 of blade 61 to a clockwise blade side edge 153 which is located 285 degrees (measured counter-clockwise) from the center plane 160 of blade 61. The relations of the other blade side edges and cutting edges and the centers of those blades are as set out in Table 1 below, and are illustrated, insofar as shown, in FIGS. 5 and 6.

As shown in FIGS. 5 and 6 and as set out in Table 1 the clockwise blade side edge 151 of the cutting edge of blade 61 extends angularly clockwise of the counterclockwise side edge 163 of the cutting edge of blade 63 and the counter clockwise side edge 161 of the cutting edge of blade 61 is located in the counter-clockwise direction of the clockwise edge of the blade 68 in the set of blades 96. Thereby the cutting edge of each of the blades as 61 overlap the circumferentially neighboring cutting edges of the blades (as 63 and 68) of the totality of remaining sets of blades of the array of blades 91.

In the preferred embodiment shown, the radial length of the arm 75 of the set of blades 93, and the radial length of the like arm 175 of the set of blades 94 are offset from each other at an angle of 45 degrees; similarly the arms as 75 (for blade 61) of all of the blades 61–68 are arrayed with equal angular spacing between such arms (and blades) between angularly (although not longitudinally ) neighboring arms (and blades) as shown in FIG. 6 and set out in Table 1.

The blades 61–68 each extend for 60 degrees circumferentially adjacent the inner surface 89 of the wall 22 from the blade clockwise side edge to the blade counter-clockwise side edge. Thus the side edge to side edge circumferential extent or distance or arc (60 degrees) covered by the cutting edge as 116 is greater than the amount of (45 degrees) offset or angle between the center planes of each such blade and the center plane of the most circumferentially proximate or neighboring blade (as 63 and 68). Thereby the cutting edges of the blades of the array of sets of blades 91 overlap each other circumferentially although those blades are spaced apart along the length of the nipple or sleeve 69 sufficiently so that none of the blades can contact each other or mechanically engage with each other especially during the pivoting movement of such blades from their lowered and laterally or radially extended paraffincutting position (as in FIGS. 7 and 8 for blade 61) to their raised and contracted or centrally located or released position (as shown in FIGS. 9 and 10 for blade 61).

TABLE 1

| | Blade | CC | P | CL |
|---|---|---|---|---|
| 61 | (161) | 30 | 0 | 330 (151) |
| 63 | (163) | 345 | 315 | 300 (153) |
| 65 | (165) | 300 | 270 | 240 (155) |
| 67 | (167) | 255 | 225 | 195 (165) |
| 62 | (162) | 210 | 180 | 150 (152) |
| 64 | (164) | 165 | 135 | 105 (154) |
| 66 | (NS) | 120 | 90 | 65 (156) |
| 68 | (NS) | 75 | 45 | 15 (158) |

CC=counterclockwise position of blade edge shown in parenthesis.

CL=clockwise position of blade edge shown in parenthesis.

P =position of center line of blade.

NS=not shown.

Figure 7:
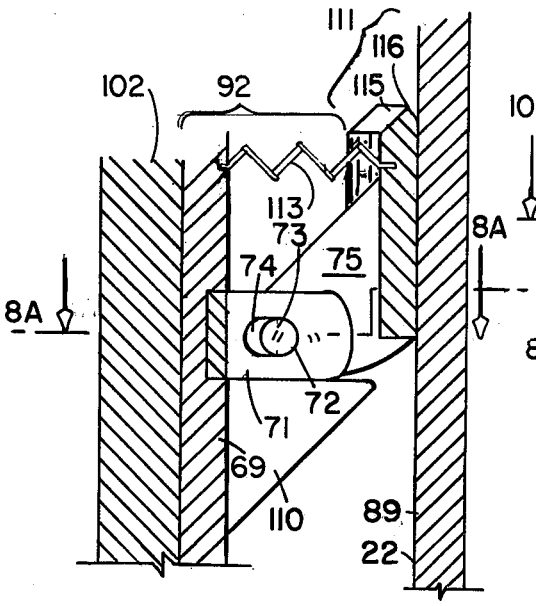
FIG. 7 is an enlarged sectional view of zone 7A of FIG. 5 along plane 7A—7A of FIG. 8 (and plane 5A—5A of FIG. 6) and showing the stripping blade 61 in the position thereof when the stripper unit 80 is moving upwards of the tubing wall 89.

In the array 91, the central longitudinal axis of each cylindrical pivot pin as 73 is located below the lower edge as 112 of the corresponding blade as 61 and the bottom edge of each arm 75 is supported on the top edge of a rigid support plate as 110 firmly attached to the nipple 69 when the blade 61 is in its lowered or extended cutting position, as shown in FIGS. 7 and 8. In the position of parts shown in FIGS. 7 and 8 the upper, cutting, edge 116 is close to the interior surface 89 of the tubing 22 except for a very narrow surface 117 (to avoid catching on edges of tubing near the recesses thereof). Upper cutting edge 111 is bevelled inward and downward at a wide ($\frac{1}{8}$ inch wide) central frustoconical surface 115. A sharp cutting edge 116 is located at the junction of a vary narrow (1/64 inch to 0.01 inch) upper lateral outwardly and downwardly bevelled frustoconical surface edge portion 117 and surface 115.

Each sucker rod 90 of the sucker rod string 120 has a central cylindrical portion 102, an upper connector end portion 103 and a bottom connector end portion 107. The upper end portion 103 has a lower frustoconical portion 104 and an upper square in transverse section portion 105. The upper portion 105 has a threaded connector as 106 attached thereto for attachment to an adjacent sucker rod as 131 in the string 120. The bottom connector portion 107 has a upper frustoconical portion 108 and an enlarged square in transverse section portion 109.

A first, lower, cylindrical rigid collar 101 of which the right half is shown in diametral longitudinal section in FIG. 5 and left half is shown in side view has an upper flat surface 121 and a lower central generally frustoconical surface 122 and a cylindrical outer surface. The collar 101 slidably embraces the cylindrical portion 102 of the sucker rod 90 and makes a smooth fit over the frustoconical portion 108 at the junction of the upper end of the lower connector portion 107 of the sucker rod and the lower part of the cylindrical portion 102 of the sucker rod 90.

A second, upper, collar 100, shown in diametral longitudinal section in FIG. 5 has a lower flat surface 125 and a upper generally frustoconical interior surface 126. That upper frustoconical surface slidably embraces the cylindrical portion 102 of rod 90 and makes a smooth fit over the lower generally frustoconical surface 104 at the junction of the lower end of the upper connector portion 103 and the upper end of the cylindrical portion 102 of that sucker rod 90. The upper flat surface 121 of the lower collar 101 and the lower flat surface 125 of the upper collar 100 both are attached to and surround and slidably fit over the sucker rod cylindrical portion 102 and prevent the stripper unit sleeve or nipple 69 from jamming on the frustoconical surfaces 104 and 108 usually found at the lower and upper end portions of the sucker rod as 90. The combination of collars as 100 and 101 and stripper unit structure permit that the sucker rod upon which the stripper unit 80 is supported may move upward and downward during the pumping operation of the sucker rod string with the nipple 69 of the unit 80 sliding on the central cylindrical portion 102 of the sucker rod 90. Thereby, when the movement of the sucker rod 90 would tend to result in movement of the collars adjacent to or past the position of the stripper unit 80 the lower surface of the upper collar (or the upper surface of the lower collar) nudges and engages and moves the adjacent top or bottom) edge of the sleeve 69 of the unit 80 and thereby moves the unit 80 downward (or upward respectively) until such unit 80 is moved to a position whereat further reciprocation of the sucker rod does not further move the unit 80. However, on upward movement of the sucker rod and pump barrel during removal of the pump, the blades 61–68 of the stripper unit 80 move to their wall-contacting position as in FIGS. 7 and 8 and the entire unit 80 is urged and moved upward while supported by the engagement of the lower collar 101 with the enlarged portion 107 of the sucker rod as 90 without wedging thereon.

The nipple 69 is made of two semi-cylindrical mating portions 78 and 79 each with one half of the stripper blades, support arms therefor, and centralizers firmly attached thereto. The two halves of the nipple and associated parts of the stripper 80 are joined together as by welding while located on the sucker rod portion as 102 to which the stripper unit is to be slidably attached.

To operate the stripper 80, it is attached to the portion as 102 of a sucker rod as 90 to be located in the tubing string 32 below the level of paraffin formation, as 19. Thereby the exterior surfaces of the cutter blades 61–68 may initially directly contact and rest upon a portion of the interior surface of the well tubing that is free of paraffin. Thereby, the cutter blades may be readily moved to their expanded position, shown in FIG. 6, by jogging the rod string or applying downward impact thereto, which will move the cutter blades to their expanded cutting position as shown in FIG. 6 if such blades are not already in such position. Such positioning of the cutter blades is effected and retained immediately after raising the sucker rod string and removing the pump barrel upward of the pump a short distance for replacement thereof and before the stripper unit 80 reaches the level of paraffin formation. When the stripper unit is moved downward with the sucker rod string to its proposed position (below the level of paraffin formation) it moves with the blades 61–68 in their retracted position (shown in FIGS. 8 and 9) due to the friction of the fluid in the well acting against the arms as 75. When the stripper units is so moved any paraffin remaining on the tubing wall and contacted thereby will locate on the inner surfaces of the cutter blades, not on the outer surface thereof, and so will not inhibit the outer surfaces of the cutting blades from making contact with the inner wall of the tubing, as is necessary for the cutter blades to subsequently effect their paraffin-removing action.

A straight line from the center of each pivot pin 72 to the geometrical center of each cutter blade as 61 in apparatus 80 is substantially at 45 degrees to the horizontal (when the sucker rod extends vertically). FIGS. 5 and 6 are drawn to scale to better illustrate the dimensions of a particular embodiment of apparatus 80 in a 2 inch internal diameter tubing 22.

On downward movement of the sucker rod string when the pump is being replaced in the well, with the stripper unit 80 attached to a rod as 90 in the string 120, the lower surface 125 of the upper collar 100 engages the upper edge of nipple 69 of the stripper unit 80 and moves that unit 80 downward with the sucker rod as 90 to which that collar is attached until the sucker rod string is in its operative pumping position. Reciprocation of the sucker rod string may cause the collar 100 to engage the sleeve 69 of the unit and move it downward to such a position that further reciprocatory movement of the sucker rod string does not further move the unit 80 and the unit 80, held by the centralizers thereof, stays fixed in location while the sucker rod moves up and down until such time as the rod string is withdrawn from the tubing. At that time the upper flat surface 121 of the lower collar 101 engages the bottom end of the sleeve or nipple 69 and forces the stripper unit 80 upward of the tubing while the stripper blades 61–68 engage and then remove paraffin adjacent the tubing walls. Thereby, although each sucker rod as 90 has an upper frustoconical connector portion 104 and a lower frustoconical connector portion 108 (which releasably yet firmly connect with adjacent upper and lower sucker rods 131 and 132 by threaded connections as 106 in such enlarged portions) the collars as 100 and 101 prevent the sleeve or nipple 69 of the stripper unit 80 from wedging and/or jamming on the frustoconical portions of the sucker rods.

When the well is pumping, the rod portion 102 travels inside the nipple 69 and the stripper unit 80 is stationary.

There is more than ample cross section area for the well fluids to travel through the spaces as 128 between parts of the stripper unit 80 when the stripper 80 is raised either by a wire line or by attaching of the stripper to the sucker rod string. The stripper paraffin comes to the surface of the well fluid and does not interfere with the pump re-entry inasmuch as the paraffin deposits as 19 are usually located at about 1,000 feet below the surface of the ground and the pump is located another 1,000 or 2,000 feet below that location.

CUTTER ASSEMBLY 180

A cutter assembly 180 is provided for operation with the system herein provided to remove paraffin deposits as 19 from well tubing walls as 22 and allow the pump plunger 28 to be withdrawn and reinserted in operative position in the pump barrel 26 at the bottom of the well tubing. The cutter assembly 180 comprises a tooth support ring, 181, ring support arms 182, 183, and 184 and a support rod 185. The support rod is a rigid steel rod, $\frac{5}{8}$ inch in diameter, attached to a connector 106 such as used on a sucker rod. The rod 185 has an upper socket 188 for connection as by coupling 186 to another sucker rod as 187, as 90, in a rod string as 120.

The tooth support ring is a solid rigid tubular element 3" long with an upper set of teeth 190 and a lower set of teeth 194 and $1\frac{7}{8}$" outside diameter. The upper set of teeth 190 comprises a set of upper peripheral teeth 191 and an upper central set of teeth 192. The lower set of teeth 194 comprises a lower peripheral set of teeth 195 and a lower central set of teeth 196. Each of the teeth of the lower peripheral set, as 197, comprises an inwardly and upwardly sloped surface 198 with a terminal or peripheral cutting edge 199 lying in the outer surface 193 of ring 181. Each tooth, as 200, of the lower central set comprises an oblique upwardly and inwardly directed flat oblique surface 201 with a terminal cutting edge 202 lying in the outer surface 193 of ring 181.

The teeth of the upper peripheral set of teeth comprise an oblique inwardly and downwardly sloped surface 203 with a terminal cutting edge as 204 lying in the outer surface 193 of ring 181. Each of the teeth in the upper central set of teeth comprises an oblique downwardly and inwardly sloped surface 205 with a terminal cutting edge 206. The edges of the lower peripheral set of teeth lie in a first flat plane and the edges of the lower central set of teeth lie in a second flat plane above or longitudinally spaced away from the first plane. The upper central teeth cutting edges lie in a third flat plane above the second plane and the upper peripheral teeth cutting edges lie in a fourth flat plane above or spaced longitudinally of the ring 181 from the third plane.

These first, second, third, and fourth flat planes are all parallel to each other and are all perpendicular to the central longitudinal axis of the cylindrical outer surface 193 of the ring 181.

In a preferred embodiment the ring 181 is three inches long from its top edge to bottom edge, i.e. from the first plane to fourth plane and there is 18 inches from the first plane to connector 106.

In operation of tool 180 in a well in which the tubing walls are already coated with paraffin deposits, when the pump is "pulled", and some paraffin remains on the walls of the well tubing, the tool 180 is then moved downward of the well tubing on the sucker rod string and scrapes paraffin from the tubing walls. The space 209 between arms 182 and 183 and space 208 between arm 183 and 184 and the space 207 between arms 182 and 184 is large enough to permit free passage of the scraped paraffin therethrough without accumulation or blockage. The scraped-off paraffin floats to the top of the well fluid and is preferably caught or dissolved in a layer as 210 of coal oil added to the well fluid. The tool 180 thus serves to clear paraffin accumulations from well tubing in wells which have an accumulation thereon when treatment by this system starts. When the well wall is cleaned before the pump is added the stripper tool 80 is particularly effective in operation and cleaning of a paraffin producing well.

THE TROWEL

Figure 15:
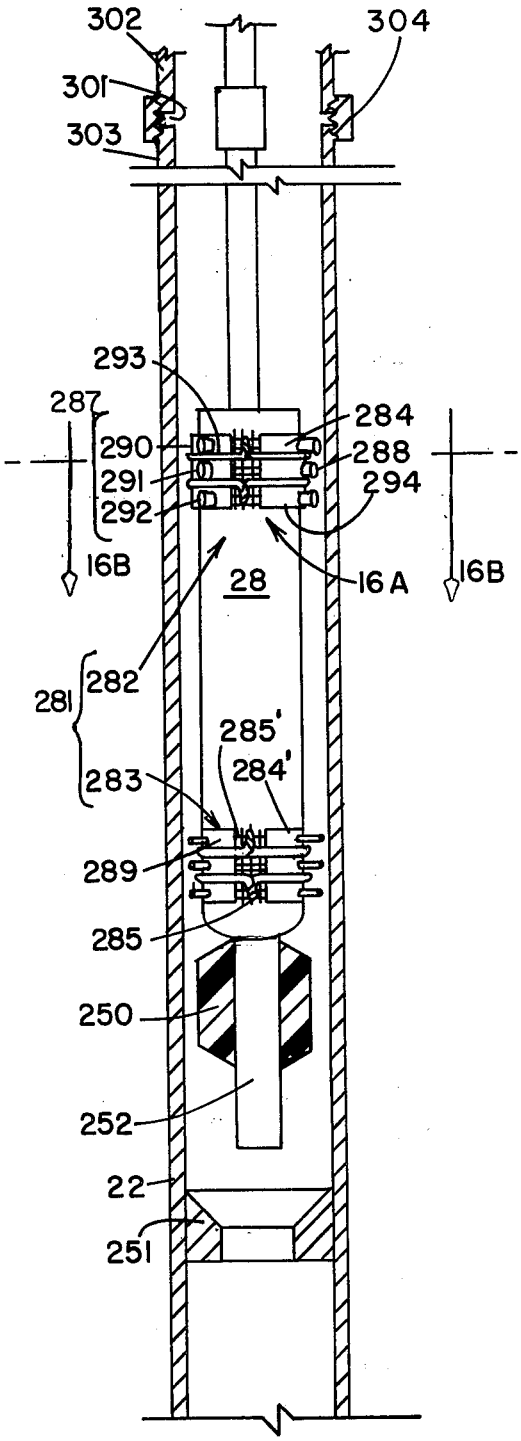
FIG. 15 is a diagrammatic vertical longitudinal diametral sectional view of the lower portion, as zone 15A of FIG. 1, of a well as 20 during operation using the trowel 250 and centralizer apparatus 281.
Figure 16A:
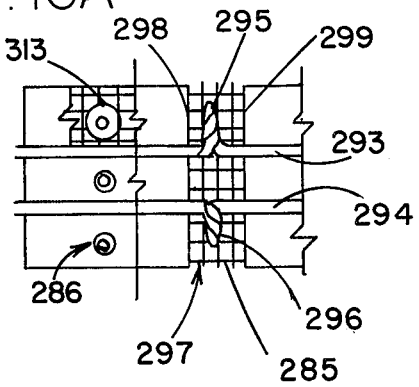
FIG. 16-A is an enlarged diagrammatic view of zone 16A of FIG. 15.
Figure 16B:
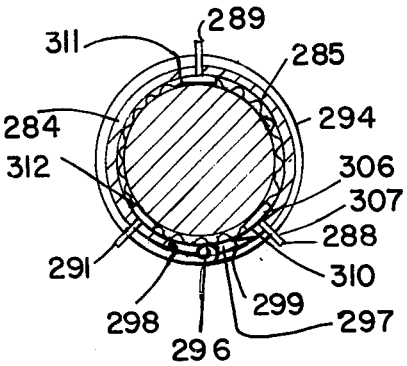

According to this invention a solid firm cylindrical mass 250, 4 inches long and $1\frac{5}{8}$ inch o.d. composed of $1\frac{1}{2}$ lb. barite, $1\frac{1}{4}$ lb. soap, and $1\frac{1}{4}$ lb. soda is attached to the gas nipple at the bottom of the pump plunger 28 as shown in FIG. 15 prior to passing the plunger through the tubing string to the seat therefor, as 251 while that plunger is attached to the sucker rod string. The mass has a hardness on the mho scale of 2 to 3 and has the hardness of a cake of hand soap. It develops a sufficiently slippery surface when in the well fluids to allow the pump barrel to slide freely thropugh the tubing and is sufficiently mechanically strong to support the 1½ inch diameter pump barrel in position spaced away from the tubing walls while the barrel is moving down the tube against the friction resistance of the tubing wall contacted thereby and has a frustoconical lower end.

The trowel 250 loosely fits the interior wall 89 of tubing 22 (2 inch internal diameter) and so serves to push before it any small amount of remaining paraffin adherent to the walls of the tubing and spread it on the tubing wall in a sufficiently thin layer that such paraffin does not contact nor adhere to the pump barrel. The mass 250 is thus sufficiently mechanically stable to space and protect the barrel surface from contact with the sides of the tubing; this spacing action avoids contact of the barrel with small accumulations of paraffin on the sides of the pump and valves associated therewith as might interfere with the subsequent pumping action of the pump. Not only does the trowel serve to protect the pump from paraffin accumulation thereon while passing to its seat but also it serves to centralize the pump plunger and locate it in the pump seat therefor. After the plunger has reached its seat the trowel mass 250 may be readily and reliably disintegrated by striking that mass against the pump seat because the trowel mass has insufficient compressive strength to withstand such stress and then crushes and is dissolved in the well fluid and permits the pump barrel to be located in its seat free of any accumulations thereon.

SWAB 260

The swab 260 comprises a rigid shaft 261, an upper, movable, rigid, weight sleeve unit 271, and a resiliently expansible sleeve unit 231.

The shaft unit 261 comprises a central rigid cylindrical rod 262 having substantially the same external diameter as the cylindrical portion of the sucker rods of the sucker rod string. The unit 261 also comprises a lower conical end 264 which conical end has a pointed lower end 254A and an upwardly extending skirt portion 265. The skirt portion 265 has an internal threaded portion 266 which matches with and is joined to the threaded shaft portion 263. The upper edge 267 of the skirt 265 has a frustoconical surface which extends downwardly and inwardly from its exterior surface to the exterior surface of the shaft 262.

The shaft 262 is provided with a plurality of transverse notches 268 and 269 which extend transversely of the length of the shaft 262. These notches are chordal in shape and provide for engaging holding members as below described. These chordal notches are equal in size and shape and spaced along the length of the shaft 262 near the junction of sleeve end 279 with the exterior surface of the shaft 262. The cylindrical surface 262 and the exterior surface of the skirt portion and the conical portion 264 of the unit 261 are coaxial with each other.

The resilient and expansible sleeve unit 231 comprises a solid mass of oil resistant rubber which is located between the upper weight sleeve unit 271 and the conical end portion 264 of the shaft unit 261 and peripheral to the outer surface of the rod 262.

The unit 231 has a cylindrical outer surface 232, which, in its contracted stable state, is of the same outer diameter as the outer surface of the sleeve 272 which is also the same outer diameter as the maximum diameter of the conical end 264 of the shaft unit 262. The unit 231 also has a top frustoconical surface 234 which is sloped outwardly and radially or outwardly and downwardly and matches the outward and downwardly directed frustoconical surface 275 at the bottom of the sleeve 272. The unit 231 also has a bottom frustoconical surface 235 which matches and has the same slope as the frustoconical surface 267 at the upper edge of the skirt 265 at the end 264 of the shaft unit 261. In the longitudinally contracted and radially expanded position of parts of the swab 260 the outer surface 232 expands to the position shown in FIG. 18 to meet and slidably engage the wall of the tubing. The expansion is controlled so there is a sliding and swabbing action rather than a locking action of the sleeve unit 231 with the interior wall 89 of the tubing 22. Such dimensional control is achieved by the relationship of the notches as 268 with the locking element on the sleeve unit 271. The sleeve unit 271 is provided with resilient locking means such as lock washers or wires, as 277 and 278, which engage the notches as 268 and 269 and firmly hold the unit 231 in its expanded position.

The shaft 262 freely slides within the cylindrical hollow of the cylindrical surface 233 of the sleeve unit 231 as well as within the inner surface 274 of the weight sleeve 272.

The upper movable rigid weight sleeve unit 271 comprises a rigid cylindrical sleeve 272 which is coaxial with the shaft 262, which shaft also is coaxial with the frustoconical portion 264. The sleeve 272 has an outer surface 273 and an inner cylindrical surface 274 both coaxial with each other and with the shaft 262. The inner surface 274 forms a readily slidable fit with the exterior surface of the shaft 262. The sleeve has a bottom edge 267 which is frustoconical in shape and slopes upwardly and inwardly at an angle of about 45 degrees to the central longitudinal axis of the shaft 262.

The sleeve 272 is firmly attached to releasable locking means 277 or 278 which are designed to be engageable with the notches 268 and 269 on the shaft 262.

Figure 18:
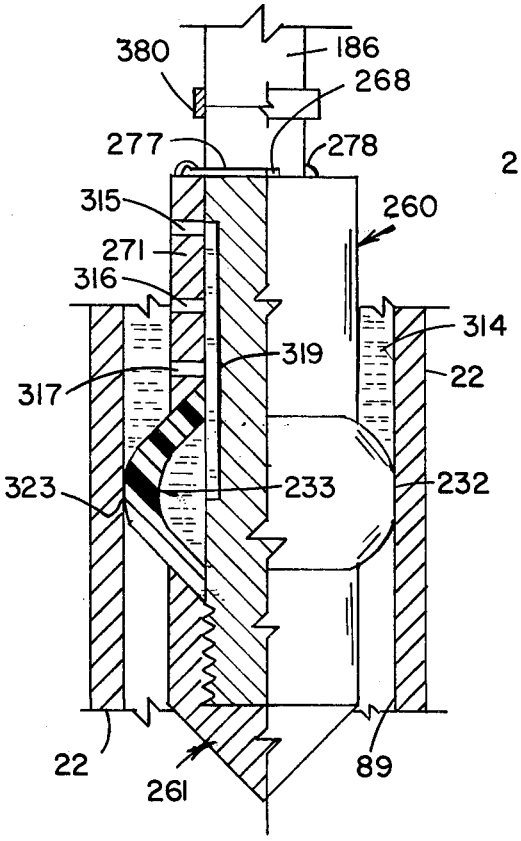
FIG. 18 is a view as in FIG. 7 in the longitudinally retracted and radially extended position of parts of swab 260.
Figure 17:
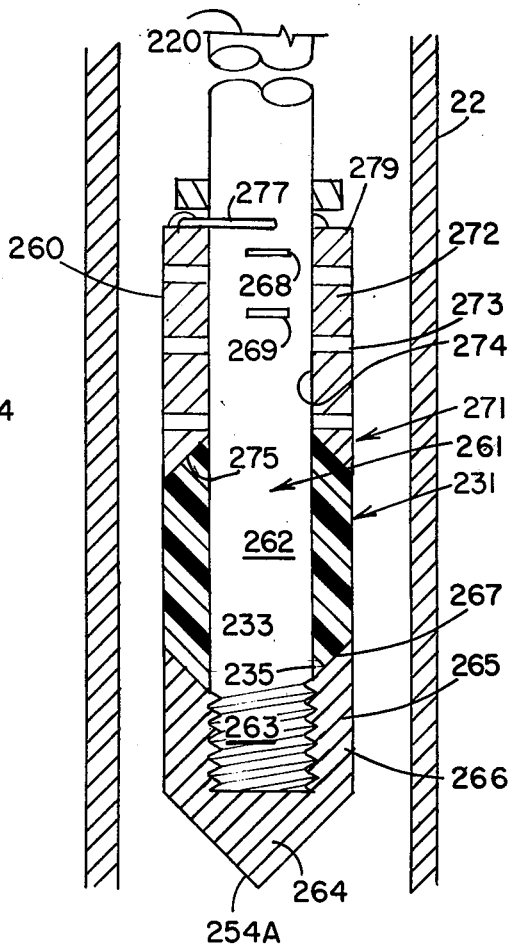
FIG. 17 is a diagrammatical vertical longitudinal sectional view of a swab 260 in its longitudinally extended and radially contracted position of parts.
Figure 19:
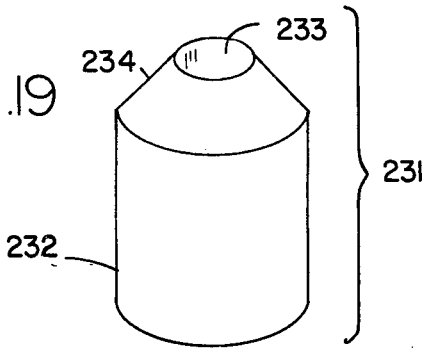
FIG. 19 is a perspective view of the resilient sleeve element 231 of the swab 260 in its longitudinally extended and radially contracted position.

In the diametrically extended longitudinally contracted position of the swab 260 as shown in FIG. 18 the sleeve 271 is moved downwardly of the shaft 262 and the flexible sleeve 231 is expanded to an outer diameter that resiliently yet slidably contacts the inner wall 89 of the tubing 22.

The flexible sleeve 231 bows out on its interior surface 233 as well as on its exterior surface 232 when it is compressed longitudinally as shown in FIG. 18. When so compressed longitudinally the channels 315–317 in the upper sleeve 271 and groove 319 in the rod 261 provide communication of the fluid 314 in the tubing above that sleeve with sleeve interior surface 233 to apply the fluid pressure of such fluid above the flexible sleeve to such interior surface. As the interior diameter of the tubing is only two inches and the shaft 262 is usually ¾ inch diameter the sleeve only needs to expand from 1¼ inch outside diameter (or 1½ inch if such size is used) to 2 inch outside diameter or a maximum of ⅜ inch expansion on each side of the rod 261. Accordingly only a small longitudinal displacement of the upper weight sleeve 271 is required for the flexible sleeve to forcefully contact the interior surface of the tubing and effect its swabbing action on the paraffin deposit on the interior surface of the tubing 22. Thus a ½ inch longitudinal displacement for a sleeve 271 with 1½ inches between outer portion of lower edge 275 of sleeve 271 and outer portion of upper edge 267 of skirt 265 provides for a cylindrical or flattened area of contact between the outer surface of sleeve 232 and the interior surface 89 of the tubing 22 as shown in FIG. 18 at 323.

In operation of the swab, the swab 260 is lowered down the tubing 22 by a wire line as 220. On jogging or on sharp impact applied to the swab 260 as by following a small but sharp lowering of the wire line the weight sleeve 271 moves to its lowered position as shown in FIG. 18 and the sleeve 231 expands to contact the inner wall 89 of the tubing 22 and so remove, on movement longitudinally of the tubing, to remove paraffin therefrom and/or to even out the deposits of paraffin on that tubing so that the pump may pass through that tubing without difficulty.

The sleeve 271 is held in position relative to the conical end 264 of the shaft 262 by engagement of the notches as 268 and 269 on the shaft 262 with the holding means or lock washers as 277 and 278 on the sleeve unit 271. The unit 260 is held on a rod string or on a wire line by a welded attachment as 380 to a connector as 186 to a wire line or a connector to a tubing string as desired by the operator.

Further, the swab may be provided with a hinged connection locating it at the bottom of a separate trowel as in FIG. 22. The flexible connection allow pulling up of the swab in the center of the tubing.

The swab 260 is used in a combination 320, with a trowel 322 as in FIG. 21. A joint 321 between the trowel 322 and swab 260 is a flexible joint so that the two tools may traverse irregularities in the interior surface of accumulations of paraffin deposits on the interior surface of the tubing. The trowel is 1¼ inch outside diameter and 14 inches long and weighs 12½ pounds. The swab 260 is 10 to 14 inches long.

CENTRALIZER

A centralizer apparatus 281 is attached to the bottom end and top end of the pump 26 to provide that the pump 26 may come to the surface 25 while traveling in the center portion of the tubing 22. Usually, the pump has an outside diameter of 1½ inch. The centralizer apparatus 281 comprises a pair of like centralizer units upper unit 282 and lower unit 283. Each centralizer unit as 282 comprises a cuff 284, a blanket 285, and an array of pins 286. Each cuff is a thin curved steel plate formed into a C-shape which closely and firmly fits the outside of the pump 26. The array of pins comprises three like sets of pins as 287, 288 and 289. Each set as 287 comprises a set of three like member pins as 290 and 291 and 292. The member pins as 290, 291, and 292 of each set of pins as 287 are located in a straight line parallel to the length of the pump—which length is parallel to the central longitudinal axis of the tubing string 22 in which the centralizer apparatus 281 operates. Each set of pins as 287 comprises three like rigid pins 290, 291, and 292. Each pin extends radially from the central longitudinal axis of the cylindrical pump 26 and each pin is firmly attached at its central end to the cuff 284. The three pins as 290, 291, and 292 of each set are arranged with the middle pin, as 291, halfway between the upper pin 290 and lower pin 292 of such set. Each set of the array, as 287, is located 120 degrees from the neighboring set, as 288, and each set has the same longitudinal spacing of the member pins thereof. The middle pin of all three sets of pins lie in the same flat plane transverse to the length of the tubing string in which the pump is located.

Each cuff, as 284 (and 284' in centralizer unit 283) is formed of rigid sheet steel about 0.010 inch thick. The blanket 285, is a sheet of soft steel screening located and compressed between the pump 26 outer surface and the cuff as 284 inner surface to provide improved frictional engagement between the pump outer surface and the inner surface of the cuff. Each cuff and screen are firmly held to the pump by a plurality of steel wires as 293 and 294 the ends of each of which wires are tightly twisted together and folded as at 295 and 296 to be located in the space 297 between the ends 298 and 299 of the cuff as 284. The components of unit 283 have same referent numerals as in unit 282 but with addition of a prime (') as 284' and 285'.

The radial edges of the pins are bevelled or rounded as hemispheres and extend to a circle of 1⅞ inch diameter, which circle is co-axial with the central longitudinal axis of the cylindrical pump 26, to which the units as 282 and 283 are attached.

The sets of pins serve to bridge over the spaces as 301 between tubing units as 302 and 303 of the tubing string 22 which tubing units are joined by collars as 304.

Each pin as 288 of the array of pins 286 comprises a rigid large diameter thin steel head portion 306 and a thin (1/16" to ⅛") and 3/16" long rigid steel shaft 307. The pin shaft 307 is firmly affixed to and extends perpendicularly to the flat head portion therefor, as 306. The shaft portion of each pin extends through a hole therefor in the cuff as 284 and extends in a radial direction from the central longitudinal axis of the cylindrical exterior surface of the pump. Each of the pins is sufficiently stiff and thin to pass through any usual paraffin deposit on the tubing wall but not jam or wedge on the wall so that the array of pins serves to locate the pump in the center of the tubing during travel of the pump along the length of the tubing when in the vicinity of paraffin deposits on the interior wall of such tubing.

Each blanket as 285 is a layer of soft wire screening and has a plurality of cut-out areas as 310, 311, 312, 313. Such cut-out areas encircle the heads as 306 of each pin as 288 in the array of pins on each centralizer unit as 282. Such cut-out areas serve to locate the pin heads as 306 and also avoids concentration of pressure between cuff and pump barrel surface near the pin head and causes the screening to engage evenly with the cuff and pump surface and hold each cuff and the pins held by such cuff in a firm fixed location on the pump barrel.

The centralizer unit 280 formed by the pump 26 and centralizer apparatus 281 may support the swab 260 and may be supported and manipulated by a wire line or rod string in the tubing 22.

FIG. 20 is a simplified top diagrammatic view of parts of the stripper assembly; it shows only a single stripper blade showing its pivotal connection to the nipple and its relations to the well tubing 22; more details of the array of blades are shown in FIG. 6. FIG. 21 is a side view of the array of the stripper blades only relative to the nipple; more details of the stripper unit are shown in FIG. 5.

Resilient spring means attached to and extending between each cutter blade as 61 and the support as 110 therefor or nipple 69 may be used to positively urge each blade as 61 to its operative position as shown in FIG. 7 at 113.

In the cutter assembly 180, the ring 181 may be cut through at a narrow (1/21") gap 381—about the width of a saw blade. The arms 181, 182 and 183 resiliently support the ring in position adjacent the inner tubing wall. The ring thereby may be contracted to accomodate to drift (i.e. dimensional irregularities) of the tubing so the outer surface of the ring hugs the wall while the cutting edges of the cutter assembly shave paraffin off the tubing wall.

I claim:

1. In the process of producing and maintaining a paraffin-producing oil well, the steps of:

(a) adding to a sucker rod string with a pump plunger at the end thereof, said rod string located in a tubing, an array of vertically extending cutting blades each with an upwardly directed sharp cutting edge, each said cutting edge extending circumferentially of said rod string for a sector of a circle and each of said upwardly directed cutting edges bevelled inwardly and downwardly adjacent and located close to the interior surface of said tubing and resiliently urged against said tubing wall, said blades longitudinally spaced apart from each other along the length of said rod string, (b) locating said sucker rod string and array of cutting blades in an oil well tubing in said paraffin-producing well, with said pump plunger in a pump barrel therefor at the bottom of said tubing, (c) producing said well and forming a paraffin deposit on the inner surface of said tubing, (d) lifting said pump plunger and rod string from said well while concurrently and automatically locating said cutting edges adjacent the inner wall of said tubing with the side edges of each said blade overlapping the side edge of two other blades of said array of blades as seen in a plane transverse to the length of said rod string and the totality of such cutting edges forming at least a complete circle and thereby shaving said paraffin deposit inwardly and away from and off said inner surface of the tubing while the tubing is full of well fluid, and then (e) replacing the pump plunger in said combination of said rod string and said array of cutting blades with a different pump plunger and locating said rod string and said array of blades in said tubing and said pump plunger in said pump barrel, (f) and again producing said well and forming a paraffin deposit on the interior surface of said tubing.

2. In a process of producing and maintaining a paraffin-producing well comprising well tubing and a rod string and a pump plunger and a pump barrel said well tubing in said well, and said rod string within said tubing, said pump barrel at the end of said tubing and said pump plunger within said pump barrel the steps of:

(a) producing said paraffin producing well and forming a paraffin deposit on the inner surface of said tubing and filling said well with well fluid, (b) removing said rod string and pump plunger while said well fluid remains in said well, (c) passing through said tubing to shave said paraffin deposit from said tubing an array of vertically extending cutting blades each with an upwardly directed sharp cutting edges, each said cutting edge extending circumferentially of said rod string for a sector of a circle and each of said upwardly directed cutting edge, bevelled inwardly and downwardly adjacent and located close to the interior surface of said tubing and resiliently urged against a wall of said tubing, (d) replacing said pump plunger with a different pump plunger and locating said rod string in said tubing and said pump plunger in said pump barrel and then (e) again producing said well.

3. In a process of producing and maintaining a paraffin-producing well comprising well tubing and a rod string and a pump plunger and a pump barrel, said well tubing in said well, and said rod string within said tubing, said pump barrel at the end of said tubing and said pump plunger within said pump barrel, the steps of:

(a) producing said paraffin producing well and forming a paraffin deposit on the inner surface of said tubing and filling said well with well fluid, (b) removing said rod string and pump plunger while said well fluid remain in said well, (c) passing through said tubing to shave said paraffin deposit from said tubing a tool comprising an array of vertically extending cutting blades each with an upwardly directed sharp cutting edge, each said cutting edge extending circumferentially of said rod string for a sector of a circle and each of said upwardly directed cutting edges bevelled inwardly and downwardly adjacent and located close to the interior surface of said tubing and resiliently positioned relative to and urged toward a wall of said tubing, (d) replacing said pump plunger with a different pump plunger and locating said rod string in said tubing with said pump plunger and then (e) again producing said well.

* * * * *